US005937239A

United States Patent [19]

Watanabe et al.

[11] Patent Number: 5,937,239

[45] **Date of Patent: *Aug. 10, 1999**

[54] PROCESS CARTRIDGE AND ELECTROPHOTOGRAPHIC IMAGE FORMING APPARATUS

[75] Inventors: Kazushi Watanabe, Mishima; Seiji Uchiyama, Numazu; Yoshihiro Ito, Yokohama; Atsushi Numagami, Mishima; Katsunori Yokoyama, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/736,596

[22] Filed: Oct. 24, 1996

[30] Foreign Application Priority Data

Oct. 25, 1995 [JP] Japan ..... 7-299341
Oct. 18, 1996 [JP] Japan ..... 8-295851

[51] Int. Cl.[6] ..... G03G 21/16; G03G 15/00

[52] U.S. Cl. ..... 399/111; 399/25; 399/90; 399/113

[58] Field of Search ..... 399/88, 90, 12, 399/13, 110, 111, 113, 25, 26, 24

[56] References Cited

U.S. PATENT DOCUMENTS 4,994,853 2/1991 Fukuchi et al. .
5,272,503 12/1993 LeSueur et al. .
5,283,613 2/1994 Midgley .
5,452,059 9/1995 Sekiya .
5,475,470 12/1995 Sasago et al. .
5,500,714 3/1996 Yashiro et al. .
5,602,623 2/1997 Nishibata et al. ..... 399/111

FOREIGN PATENT DOCUMENTS 0 393 627 4/1990 European Pat. Off. .
0586042 3/1994 European Pat. Off. .
0 699 978 3/1996 European Pat. Off. .
0699978 3/1996 European Pat. Off. .
63-212956 9/1988 Japan .
2-160262 6/1990 Japan .
2-306257 12/1990 Japan .
6-202406 7/1994 Japan .
7-168485 7/1995 Japan .
8-160680 6/1996 Japan .
8-185094 7/1996 Japan .

*Primary Examiner*—Matthew S. Smith
*Attorney, Agent, or Firm*—Fitzpatrick, Cella, Harper & Scinto

[57] ABSTRACT

The present invention provides a process cartridge removably mounted to an electrophotographic image forming apparatus. The process cartridge includes; a cartridge frame, an electrophotographic photosensitive member provided within the cartridge frame, a process device for acting on the electrophotographic photosensitive member, a memory device for storing information to be transmitted to the electrophotographic image forming apparatus, a positioning portion for positioning the cartridge frame with respect to the image forming apparatus when the process cartridge is mounted to the image forming apparatus, and an exposure opening provided in the cartridge frame and to pass information light from the image forming apparatus to be illuminated on the electrophotographic photosensitive member when the process cartridge is mounted to the image forming apparatus.

37 Claims, 10 Drawing Sheets

C
P
12c6
12c2
12c1
12c
12d
20
12
B
12c6
9
X
12a

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an image forming apparatus to which such a process cartridge can removably be mounted. The electrophotographic image forming apparatus may be, for example, an electrophotographic copying machine, an electrophotographic printer (for example, an LED printer, a laser beam printer and the like), an electrophotographic facsimile system, an electrophotographic word processor or the like.

Further, the process cartridge may incorporate therein an electrophotographic photosensitive member and a charge means, a developing means or a cleaning means as a unit which can removably be mounted to an electrophotographic image forming apparatus, or may incorporate therein an electrophotographic photosensitive member and one of a charge means, a developing means and a cleaning means as a unit which can removably be mounted to an electrophotographic image forming apparatus, or may incorporate therein an electrophotographic photosensitive member and at least a developing means as a unit which can removably be mounted to an electrophotographic image forming apparatus.

2. Description of the Related Art

In conventional image forming apparatuses using an electrophotographic image forming process, an electrophotographic photosensitive member and process means acting on the electrophotographic photosensitive member are incorporated into a process cartridge which can removably be mounted to the image forming apparatus. According to such a process cartridge, since maintenance can be performed by the user himself without any expert person, the operability can greatly be improved. Thus, the process cartridge has widely been used in various image forming apparatuses.

The present invention relates to the improvement in conventional process cartridges and image forming apparatuses.

SUMMARY OF THE INVENTION

An object of the present invention is to provide a process cartridge and an electrophotographic image forming apparatus to which such a process cartridge can be removably be mounted, wherein a memory means of the process cartridge can electrically connected to a body of the image forming apparatus stably.

Another object of the present invention is to provide a process cartridge and an electrophotographic image forming apparatus to which such a process cartridge can removably be mounted, wherein, when the process cartridge is mounted to the image forming apparatus, a memory means of the process cartridge does not interfere with conveyance of a recording medium.

A further object of the present invention is to provide a process cartridge and an electrophotographic image forming apparatus to which such a process cartridge can removably be mounted, wherein the process cartridge can be mounted to the image forming apparatus with high accuracy and a memory means of the process cartridge can electrically be connected to a body of the image forming apparatus stably.

A still further object of the present invention is to provide a process cartridge which can removably be mounted to an electrophotographic image forming apparatus, comprising a cartridge frame, an electrophotographic photosensitive member provided within the cartridge frame, a process means acting on the electrophotographic photosensitive member, a memory means for storing information to be transmitted to the electrophotographic image forming apparatus, a positioning portion for positioning the cartridge frame with respect to the image forming apparatus, and an exposure opening provided in the cartridge frame and adapted to pass information light from the image forming apparatus to be illuminated on the electrophotographic photosensitive member when the process cartridge is mounted to the image forming apparatus. The process cartridge is mounted to the image forming apparatus from a direction transverse to an axis of the electrophotographic photosensitive member, and the memory means is provided on a tip end portion of the cartridge frame regarding the direction along which the process cartridge is mounted to the image forming apparatus or on a portion of the cartridge frame near the exposure opening. The present invention further provides an electrophotographic image forming apparatus to which such a process cartridge can removably be mounted.

Another object of the present invention is to provide a process cartridge which can removably be mounted to an electrophotographic image forming apparatus, comprising an electrophotographic photosensitive drum, a charge member for charging the electrophotographic photosensitive drum, a drum frame for supporting the photosensitive drum and the charge member, a developing member for developing a latent image formed on the electrophotographic photosensitive drum, and a developing toner frame supporting the developing member and having a toner containing portion for containing toner and pivotally connected to the drum frame. The process cartridge further comprises an exposure opening provided in the cartridge frame provided along a longitudinal direction of the electrophotographic photosensitive drum and adapted to pass information light from the image forming apparatus to be illuminated on the electrophotographic photosensitive member when the process cartridge is mounted to the image forming apparatus, a projecting member protruded from the drum frame outwardly in a direction coaxial with an axis of the electrophotographic photosensitive drum and adapted to be supported by a support member of the image forming apparatus when the process cartridge is mounted to the image forming apparatus, a contact portion provided on the drum frame and adapted to be contacted with a fixed member of the image forming apparatus when the process cartridge is mounted to the image forming apparatus and further adapted to prevent the process cartridge from rotating toward a rotational direction of the electrophotographic photosensitive member, and a memory member provided on the drum frame and adapted to store information to be transmitted to the electrophotographic image forming apparatus. The process cartridge is mounted to the image forming apparatus from a direction transverse to an axis of the electrophotographic photosensitive member, and the memory member is disposed forwardly of the exposure opening in a direction along which the process cartridge is mounted to the image forming apparatus.

The present invention further provides an electrophotographic image forming apparatus to which such a process cartridge can removably be mounted.

DETAILED DESCRIPTION OF PREFERRED EMBODIMENTS

The present invention will now be explained in connection with embodiments thereof with reference to the accompanying drawings.

First Embodiment

A process cartridge and an electrophotographic image forming apparatus according to a first embodiment of the present invention will now be explained concretely with reference to FIGS. 1 to 8. First of all, entire constructions of a process cartridge and an electrophotographic image forming apparatus to which such a process cartridge is mounted will be explained with reference to FIGS. 1 to 4, and then, a memory means of the process cartridge and connection between the memory means and the electrophotographic image forming apparatus will be explained.

Figure 1:
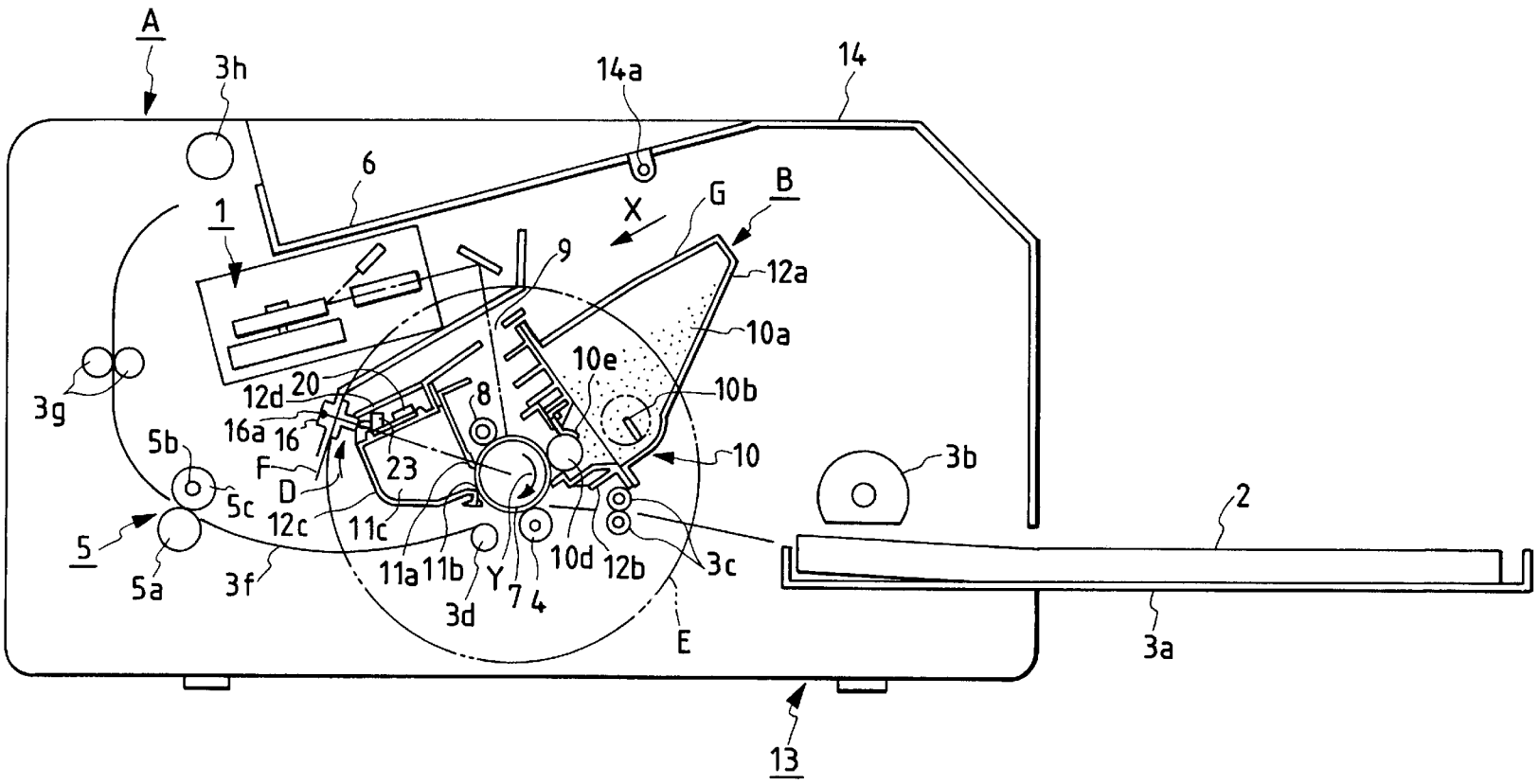
FIG. 1 is a side sectional view of an electrophotographic image forming apparatus using a process cartridge according to a first embodiment of the present invention.

As shown in FIG. 1, in the electrophotographic image forming apparatus (a laser beam printer in the illustrated embodiment) A, a latent image is formed on a photosensitive layer of a drum-shaped electrophotographic photosensitive member (photosensitive drum) 7 by illuminating a laser light image from an optical system 1 onto the photosensitive drum in response to image information, and the latent image is visualized with toner as a toner image. Synchronously with the formation of the toner image, a recording medium 2 is supplied from a sheet supply cassette 3*a* by a convey means comprising of a pick-up roller 3*b*, a pair of convey rollers 3*c* and a convey roller 3*d*. In an image forming portion formed as a process cartridge B, the toner image formed on the photosensitive drum 7 is transferred onto the recording medium 2 by applying voltage to a transfer roller (transfer means) 4 of the image forming apparatus. The recording medium 2 to which the toner image was transferred is sent to a fixing means 5 while being guided by a guide plate 3*f*. The fixing means 5 includes a drive roller 5*a* and a fixing roller 5*c* having a heater 5*b* therein, so that heat and pressure are applied to the recording medium 2, thereby fixing the toner image to the recording medium. Thereafter, the recording medium 2 is conveyed by a pair of discharge rollers 3*g* and a discharge roller 3*h* to discharge the recording medium onto a discharge portion 6 through a reverse rotation convey path.

On the other hand, the process cartridge B has the electrophotographic photosensitive member and at least one process means. The process means may be, for example, a charge means for charging the electrophotographic photosensitive member, a developing means for developing the latent image formed on the electrophotographic photosensitive member or/and a cleaning means for removing toner remaining on the electrophotographic photosensitive member.

Figure 2:
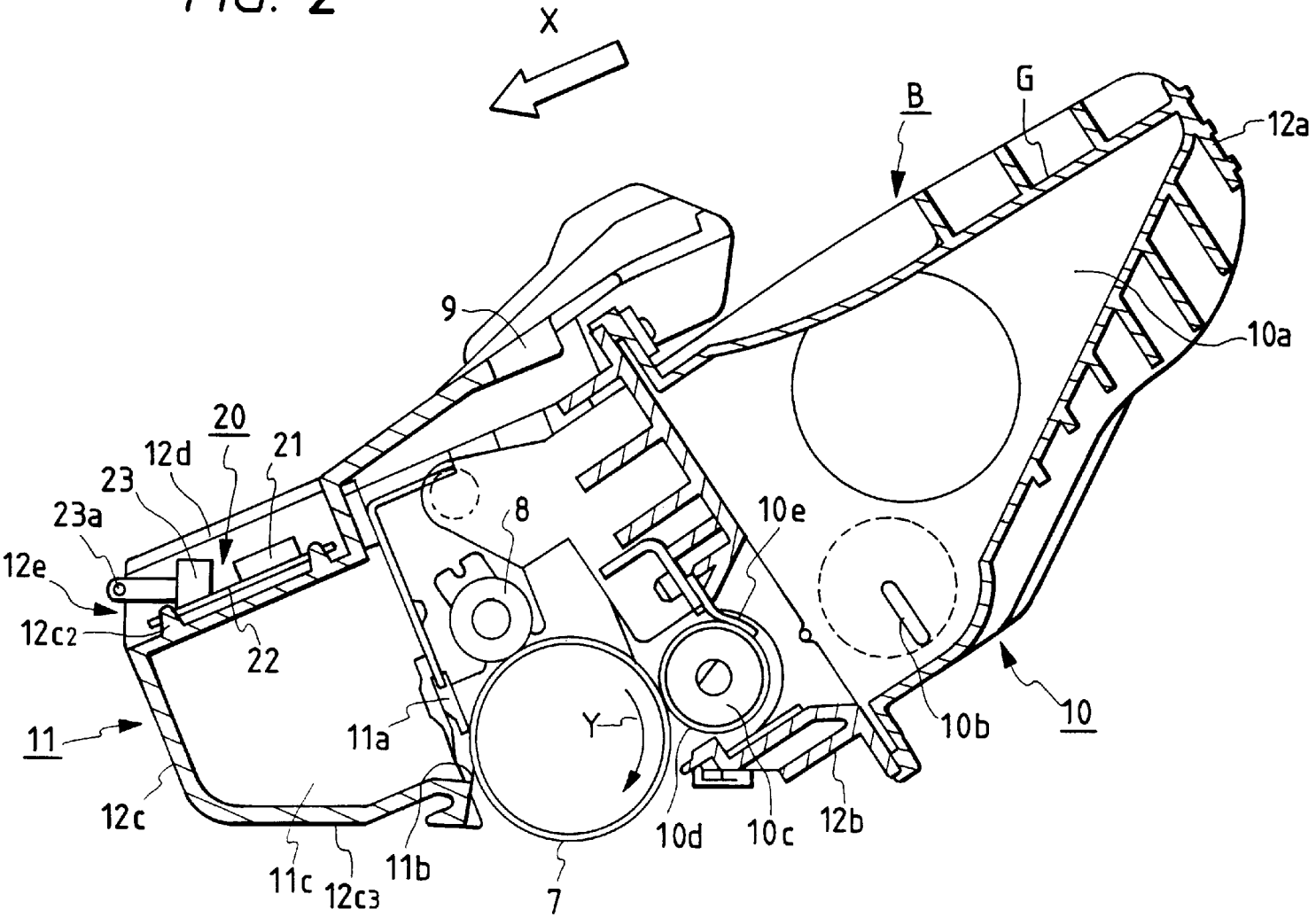
FIG. 2 is a sectional view of a process cartridge according to first and second embodiments of the present invention.
Figure 3:
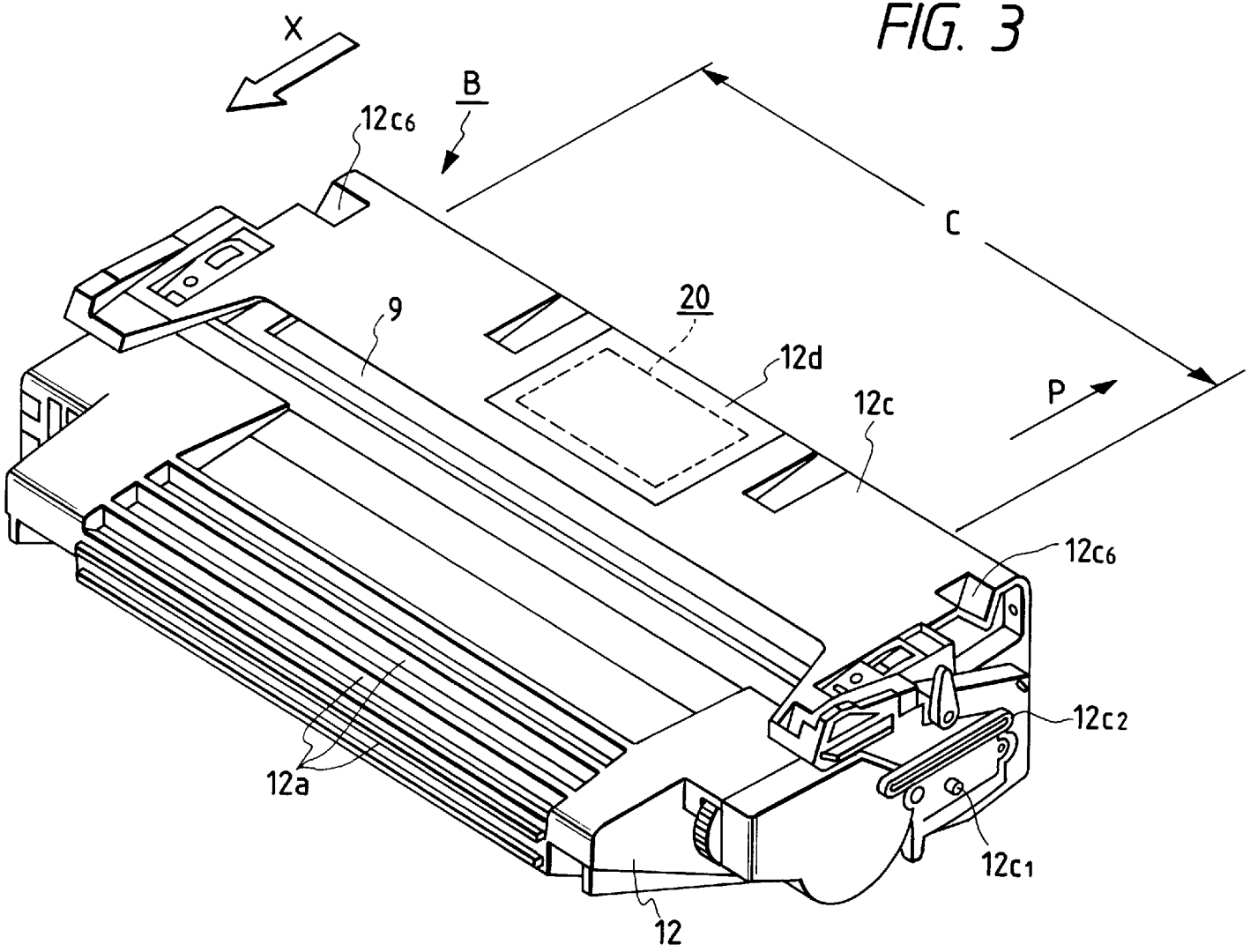
FIG. 3 is a perspective view of the process cartridge of FIG. 2.

As shown in FIGS. 2 and 3, in the process cartridge B according to the illustrated embodiment, the photosensitive drum 7 having the photosensitive layer at its peripheral surface is rotated, and the surface of the photosensitive drum is uniformly charged by applying voltage to the charge means (charge roller) 8. Then, the image information light from the optical system 1 is illuminated on the photosensitive drum 7 through an exposure opening 9 formed in the process cartridge B, thereby forming the latent image. Then, the latent image formed on the photosensitive drum 7 is developed with toner to form a toner image.

In a developing means 10, the toner contained in a toner containing portion 10*a* is fed out by a toner feed member 10*b* and a developing roller 10*d* having a fixed magnet 10*c* therein is rotated. A toner layer is formed on a surface of the developing roller 10*d* while applying frictional charges to the toner layer by a developing blade 10*e*, and, by transferring the toner on the toner layer to the latent image on the photosensitive drum 7, the toner image is formed.

After the toner image is transferred to the recording medium 2 (for example, a recording paper sheet, an OHP sheet, cloth or the like) by applying voltage having polarity opposite to that of the toner image to the transfer roller 4 of the image forming apparatus, the toner remaining on the photosensitive drum 7 is removed by a cleaning blade 11*a*. The removed toner is received by a dip sheet 11*b* and then is collected in a removed toner reservoir 11*c*. In the illustrated embodiment, the toner remaining on the photosensitive drum 7 is removed by a cleaning means constituted by the cleaning blade 11*a*, dip sheet 11*b* and removed toner reservoir 11*c*.

Incidentally, several members such as the photosensitive drum 7 and the like are contained in a cartridge frame. The cartridge frame has a developing unit 12*d* and a cleaning unit 12*e*. That is to say, the developing unit 12*d* is formed by welding a toner frame 12*a* having a toner containing portion 10*a* to a developing frame 12*b* for holding the developing roller 10*d* and the like. And, the process cartridge is constituted by rockably connecting a cleaning unit 12*e* having the photosensitive drum 7 and the cleaning means 11 to the developing unit 12*d*. The process cartridge B can removably be mounted to a cartridge mounting means of a body 13 of the image forming apparatus.

Figure 4:
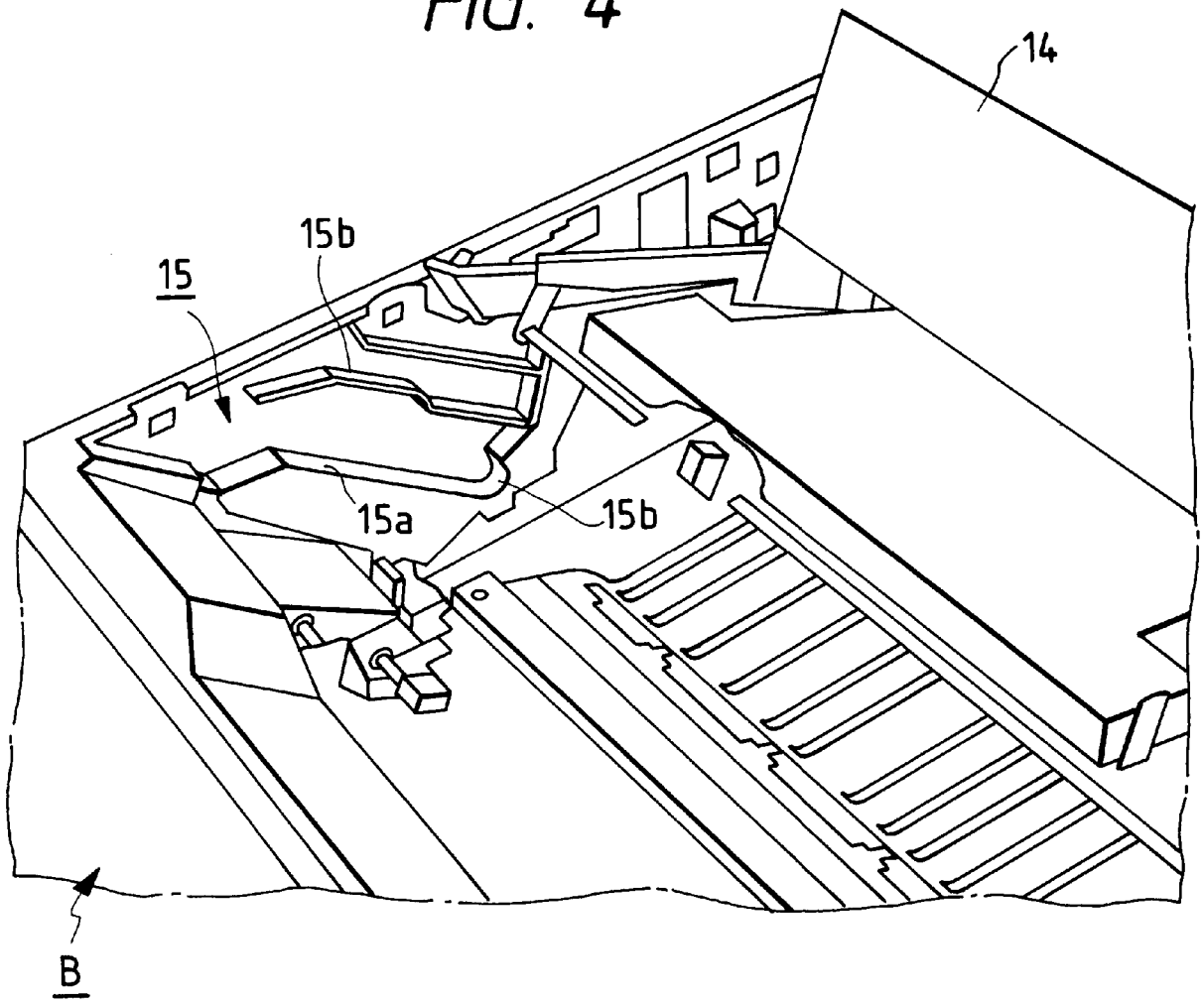
FIG. 4 is a partial perspective view of an electrophotographic image forming apparatus to which the process cartridge of FIG. 2 is mounted.

When an open/close cover 14 is opened around a shaft 14*a* (FIG. 1), as shown in FIG. 4, the cartridge mounting means includes opposed cartridge mounting guide members 15 formed on left and right side walls of a cartridge mounting space (only one guide member is shown in FIG.

4), and the mounting guide members 15 have opposed guide portions 15*a* for guiding the insertion of the process cartridge B. The process cartridge B is mounted to the image forming apparatus A by inserting bosses 12*c*1 protruded from both longitudinal sides of the cleaning frame 12*c* as shown in FIG. 3 into the guide portions 15*a*, by fitting the bosses 12*c*1 of the cartridge in positioning portions 15*b* contiguous with the guide portions 15*a* to position the cleaning unit 12*e* with respect to the image forming apparatus A and by closing the open/close cover 14.

Explaining in more detail, in the illustrated embodiment, above the bosses 12*c*1, elongated longitudinal guide portions 12*c*2 are formed on the cleaning frame 12*c* to protrude outwardly therefrom. When the process cartridge B is mounted to the image forming apparatus A, the cartridge B is inserted into the mounting position while guiding the bosses 12*c*1 by the guide portions 15*a* and the longitudinal guide portions 12*c*2 by the guide portions 15*b*. In this way, the process cartridge B is mounted on the image forming apparatus A in a condition that the bosses 12*c*1 are fitted in the positioning portion 15*a* and the longitudinal guide portions 12*c*2 are spaced apart from the guide 15*b* (refer to FIG. 8). In this case, a helical gear G2 provided on an end of the photosensitive drum 7 is engaged by a helical gear G1 provided on the image forming apparatus A. Thereafter, when the helical gear G1 is rotated (in an anti-clockwise direction in FIG. 8), the photosensitive drum 7 is rotated (in a clockwise direction Y in FIGS. 1, 2, 5, 6 and 7) via the helical gear G2 (rotated in a clockwise direction in FIG. 8).

In this way, a driving force of the image forming apparatus A is transmitted to the process cartridge B. In this case, the process cartridge B is subjected to a biasing force tending to rotate the process cartridge around the bosses 12*c*1 in the same direction as a rotational direction of the photosensitive drum 7. As a result, an abutment portion (recessed portion) 12*c*6 (FIGS. 3 and 8) abuts against a fixed member 100 (FIG. 8) provided on the image forming apparatus A. Consequently, the cleaning unit 12*e* of the process cartridge B is positioned with respect to the image forming apparatus A.

Incidentally, the developing unit 12*d* is rockably attached to the cleaning unit 12*e*. A peripheral surface of the developing roller 10*d* of the developing unit 12*d* is biased against a peripheral surface of the photosensitive drum 7 of the cleaning unit 12*e* through spacers (not shown) by an elastic force of springs (not shown). Thus, while the cleaning unit 12*e* (cleaning frame 12*c*) is directly positioned with respect to the image forming apparatus A, the developing unit 12*d* (developing frame 12*b* and toner frame 12*a*) is not directly positioned with respect to the image forming apparatus A but is positioned with respect to the image forming apparatus A by being positioned with respect to the cleaning unit 12*e*.

Incidentally, the bosses are protruded members protruded outwardly from the cleaning frame 12*c* in a direction coaxial with an axis of the photosensitive drum 7. The protruded members may be drum shaft portions (for supporting the photosensitive drum to the cleaning frame 12*c*) protruded outwardly of the cleaning frame 12*c* or may be parts of the cleaning frame 12*c* protruded outwardly.

Next, a memory means 20 of the process cartridge B will be explained with reference to FIGS. 2 and 3. The memory means 20 has a memory chip 21 such as a RAM or a ROM. Information required for the memory chip 21 is previously stored so that a using condition of the process cartridge is informed to a control portion (not shown) of the image forming apparatus by effecting transmission of information between the process cartridge and the image forming apparatus when the process cartridge is mounted on the image forming apparatus.

As shown in FIGS. 2 and 3, the memory chip 21 is attached to a base plate 22 positioned by bosses 12*c*2 on an upper portion of the cleaning frame 12*c* in a convey area C in a direction (longitudinal direction) transverse to the longitudinal direction of the photosensitive drum 7 and is covered by a cover member 12*d* secured to the cleaning frame 12*c* by screws (not shown). The cover member 12*d* is opened at a front portion (12*e*) in a mounting direction X along which the cartridge B is mounted to the image forming apparatus A, so that the memory means 20 can surely be connected to an electric contact of the image forming apparatus A electrically. Further, the memory chip 21 may be solely attached to the cleaning frame.

Furthermore, in the illustrated embodiment, while an example that the memory means 20 is mounted on the upper portion of the cleaning frame was explained, the memory means may be mounted on any portion of the cleaning frame 12*c* other than a recording medium passing zone 12*c*3 of the longitudinal convey area C. The convey area C is a portion of an outer peripheral surface area of the cartridge corresponding to a recording medium conveying path when the process cartridge B is mounted on the image forming apparatus A. Further, the recording medium passing zone 12*c*3 is a region where the recording medium is opposed to the recording medium conveying path when the process cartridge B is mounted on the image forming apparatus A.

As mentioned above, by providing the memory means 20 on the cleaning frame 12*c* positioned with respect to the image forming apparatus when the process cartridge B is mounted on the image forming apparatus A, the electrical connection between the memory means 20 and the image forming apparatus can be stabilized. Further, since the memory means is disposed within the longitudinal convey area, longitudinal dimensions of the process cartridge and the image forming apparatus can be shortened.

Further, since a lower portion of the removed toner reservoir 11*c* of the cleaning frame 12*c* has a continuous surface for sending the removed toner toward a rear side when the removed toner is collected within the removed toner reservoir 11*c*, even when the memory means is disposed at the upper portion of the cleaning frame 12*c*, the memory means does not have a bad influence upon the collection of the removed toner.

Second Embodiment

Next, a second embodiment of the present invention will be explained with reference to FIGS. 1 and 2. This second embodiment is characterized regarding the electrical connection between the memory means and the image forming apparatus.

The memory chip 21 mounted on the process cartridge B is attached to the base plate 22, and a cartridge electric portion 23 for electrical connection to the image forming apparatus A is attached to the base plate 22. An electric contact 16 is on the image forming apparatus at a position where the electric contact is opposed to an electric contact 23*a* provided at a tip end of the electric portion 23, so that the electric contacts are electrically interconnected when the process cartridge B is mounted on the image forming apparatus A.

Further, as explained in connection with FIGS. 3 and 4, the bosses 12*c*1 of the process cartridge B are fitted in the positioning portions 15*b* of the image forming apparatus.

Thus, when the process cartridge B is subjected to the driving force from the image forming apparatus A, although the force tending the process cartridge to rotate around the bosses 12*c*1 in the direction D within the image forming apparatus, the rotation of the process cartridge is prevented by the abutment portion 100 (FIG. 8), thereby maintaining the posture of the process cartridge B. Thus, the electric contact 16 can be moved in a plane F where the electric contact is contacted with a circumference E coaxial with a center of rotation (drum center) around which the process cartridge B is rotated when the process cartridge is subjected to the driving force from the image forming apparatus A.

Figure 9:
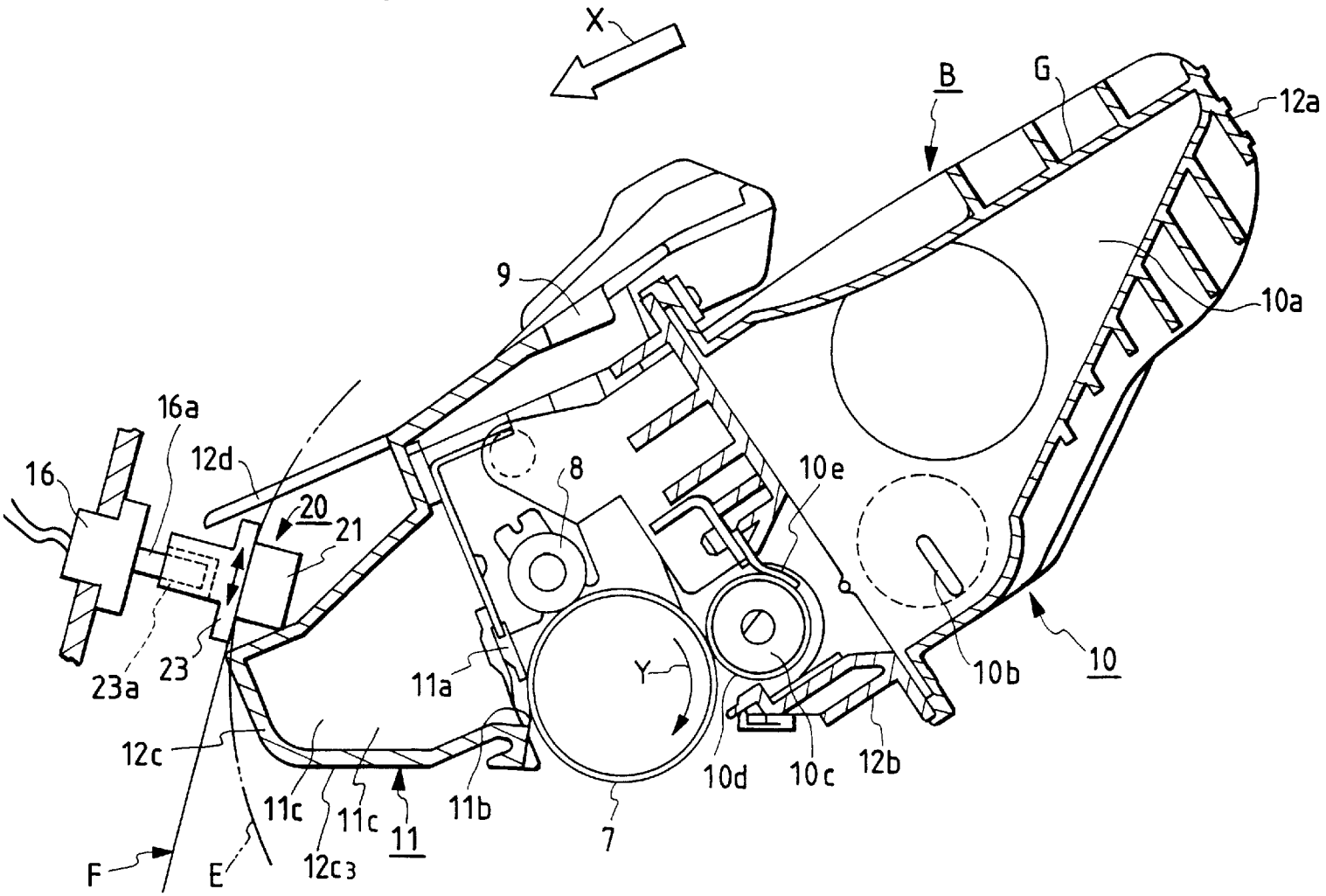
FIG. 9 is a side sectional view of the process cartridge to which the memory is movably attached.
Figure 10A:
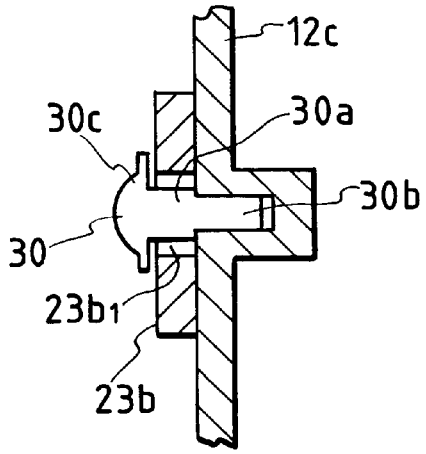
FIG. 10A is a side sectional view showing a condition that the memory means is attached to a cartridge frame.
Figure 10B:
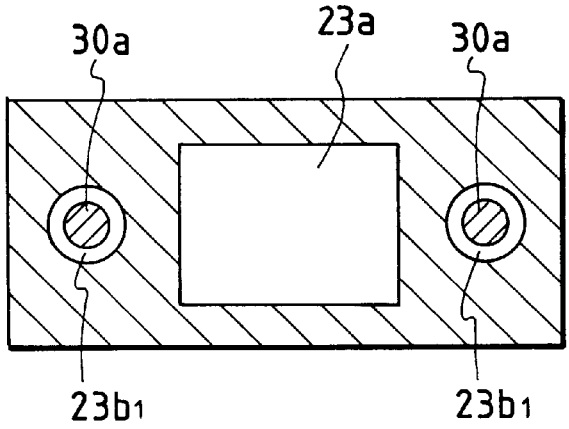
FIG. 10B is a plan view showing a condition that the memory means is attached to the cartridge frame.

In the illustrated embodiment, while an example that the electric contact of the image forming apparatus can be moved was explained, the electric contact of the memory means of the process cartridge may be moved as shown in FIGS. 9, 10A and 10B. Further, both electric contacts may be moved.

Now, the case where the electric contact of the memory means of the process cartridge B is movable will be explained with reference to FIGS. 9, 10A, 10B and 11. In FIG. 9, the memory chip 21 is integrally connected to the cartridge electric portion 23. More particularly, as shown in FIGS. 10A and 10B, a flange portion 23*b* of the cartridge electric portion 23 is attached, by screws 30, to a surface of the cleaning frame 12*c* aligned with the plane F contacting with the imaginary circle E coaxial with the rotational center around which the process cartridge B is rotated when the process cartridge is subjected to the driving force from the drive gear G1 of the image forming apparatus. Each screw 30 includes a threaded portion 30*b*, a shank portion 30*a* and a head portion 30*c*, and the threaded portion 30*b* is threaded into the cleaning frame 12*c*.

The shank portion 30*a* is received in a hole 23*b*1 of the flange portion 23*b* of the cartridge electric portion 23 with clearance fit. The head portion 30*c* serves to prevent the cartridge electric portion 23 from dropping from the cleaning frame 12*c*. Since a length of the shank portion 30*a* is selected to be greater than a thickness of the flange portion 23*b* of the cartridge electric portion, the cartridge electric portion 23 is not secured to the cleaning frame 12*c* by a tightening force of the screw 30. Further, since there is the clearance between the shank portion 30*a* and the hole 23*b*1 of the flange portion 23*b*, the cartridge electric portion 23 can be moved by an amount corresponding to the clearance in a plane contacting with the imaginary circle coaxial with the rotational center of the process cartridge rotated when the driving force acts on the process cartridge.

Figure 11:
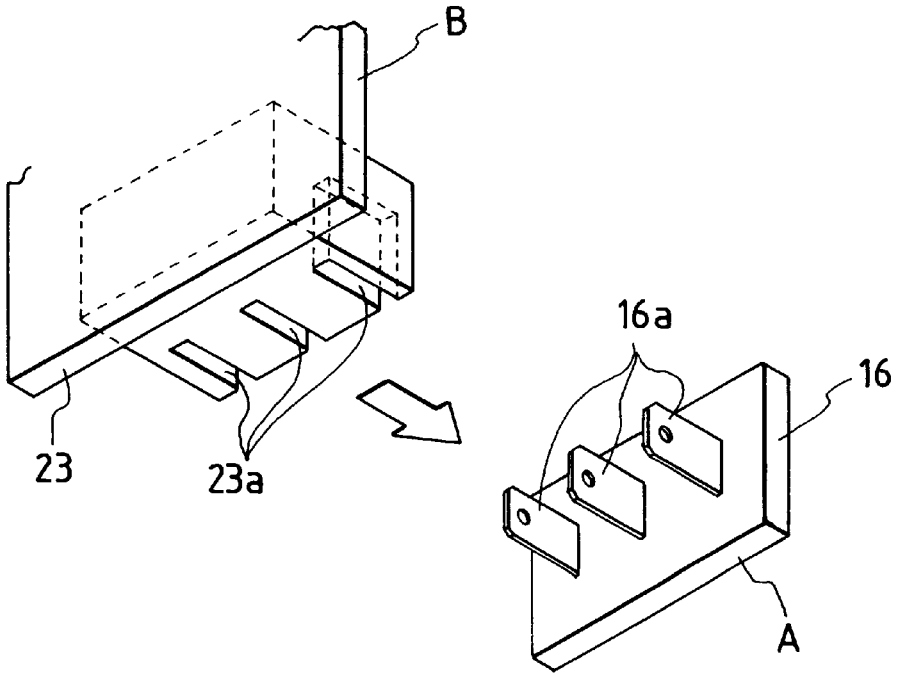
FIG. 11 is an enlarged perspective view of the electric contact shown in FIGS. 9, 10A and 10B.

As shown in FIG. 11, each of the cartridge electric contacts 23*a* and the main body electric contact 16*a* are provided at three positions. The cartridge electric contact 23*a* is cut at an edge portion thereof to be released. So, when an operator grips the grip portion G of the process cartridge B to mount the process cartirdge onto the apparatus main body A, the protrusion-like main body electric contact 16*a* goes into the groove-like cartridge electric contact 23*a*, thus both contacts are electrically connected with each other.

Thereafter, even if the cartridge electric contact 23*a* moves in the direction shown by the arrow F, the main body electric contact merely moves within or along the cartridge electric contact while maintaining the electrically connected relation.

That is to say, the memory means 20 has the cartridge electric contact 23*a* adapted to be connected to the electric contact 16 of the image forming apparatus A when the process cartridge B is mounted on the image forming apparatus A. The cartridge electric contact 23*a* can be moved in the plane F contacting with the imaginary circle E coaxial with the rotational center 12*c*1 of the process cartridge B rotated when the process cartridge is subjected to the driving force from the image forming apparatus A. Alternatively, the electric contact 16 of the image forming apparatus can be moved in the plane contacting with the imaginary circle coaxial with the rotational center of the process cartridge B rotated when the process cartridge is subjected to the driving force from the image forming apparatus A.

By using the above-mentioned electrical connection of the memory means, when the process cartridge B is subjected to the driving force within the image forming apparatus, the process cartridge B can positively abut against the abutment member 100 of the image forming apparatus in the rotational direction, and the process cartridge does not affect an influence upon the positioning between the cartridge and the image forming apparatus in the longitudinal direction of the process cartridge (transverse to the longitudinal direction of the photosensitive drum).

Third Embodiment

Figure 5:
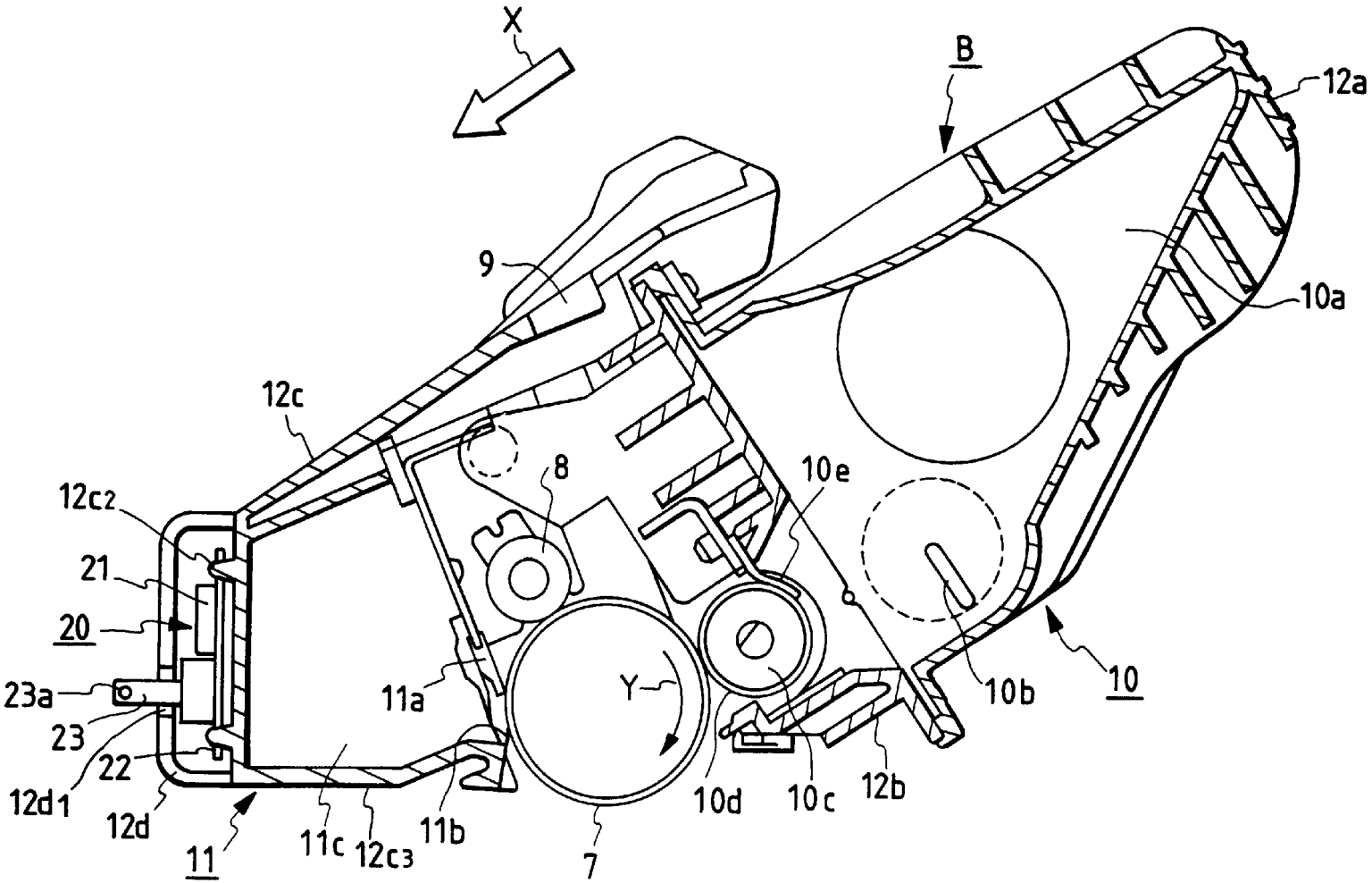
FIG. 5 is an explanatory view showing an electrical connection between a memory means and an image forming apparatus, according to a third embodiment of the present invention.

Next, a third embodiment of the present invention will be explained with reference to FIG. 5. In this third embodiment, the electrical connection between the memory means and the image forming apparatus differs from that of the second embodiment.

In the third embodiment, the memory means 20 is disposed at a tip end of the process cartridge B in the longitudinal direction of the cartridge (i.e. a cartridge mounting direction). More specifically, boss portions 12*c*2 are formed on a vertical wall of the cleaning frame 12*c*, the base plate 22 is secured to the boss portions 12*c*2, the memory chip 21 is attached to the base plate 22, and the memory chip is covered by the cover member 12*d*.

Incidentally, in the above-mentioned embodiments, the process cartridge B is mounted to the image forming apparatus A from the direction (shown by the arrow X) transverse to the longitudinal direction of the photosensitive drum.

Further, the electric connection portion (cartridge electric portion) 23 for effecting electrical connection to the image forming apparatus is attached to the base plate 22, and the electric contact 23*a* is electrically connected with the electric contact 16 of the image forming apparatus through a through hole 12*d*1 formed in the cover member 12*d*.

With this arrangement, the electric contacts are interconnected synchronously with the mounting operation of the process cartridge B to the image forming apparatus.

Also in this third embodiment, the same advantages as those of the previous embodiments are obtained.

Fourth Embodiment

Figure 6:
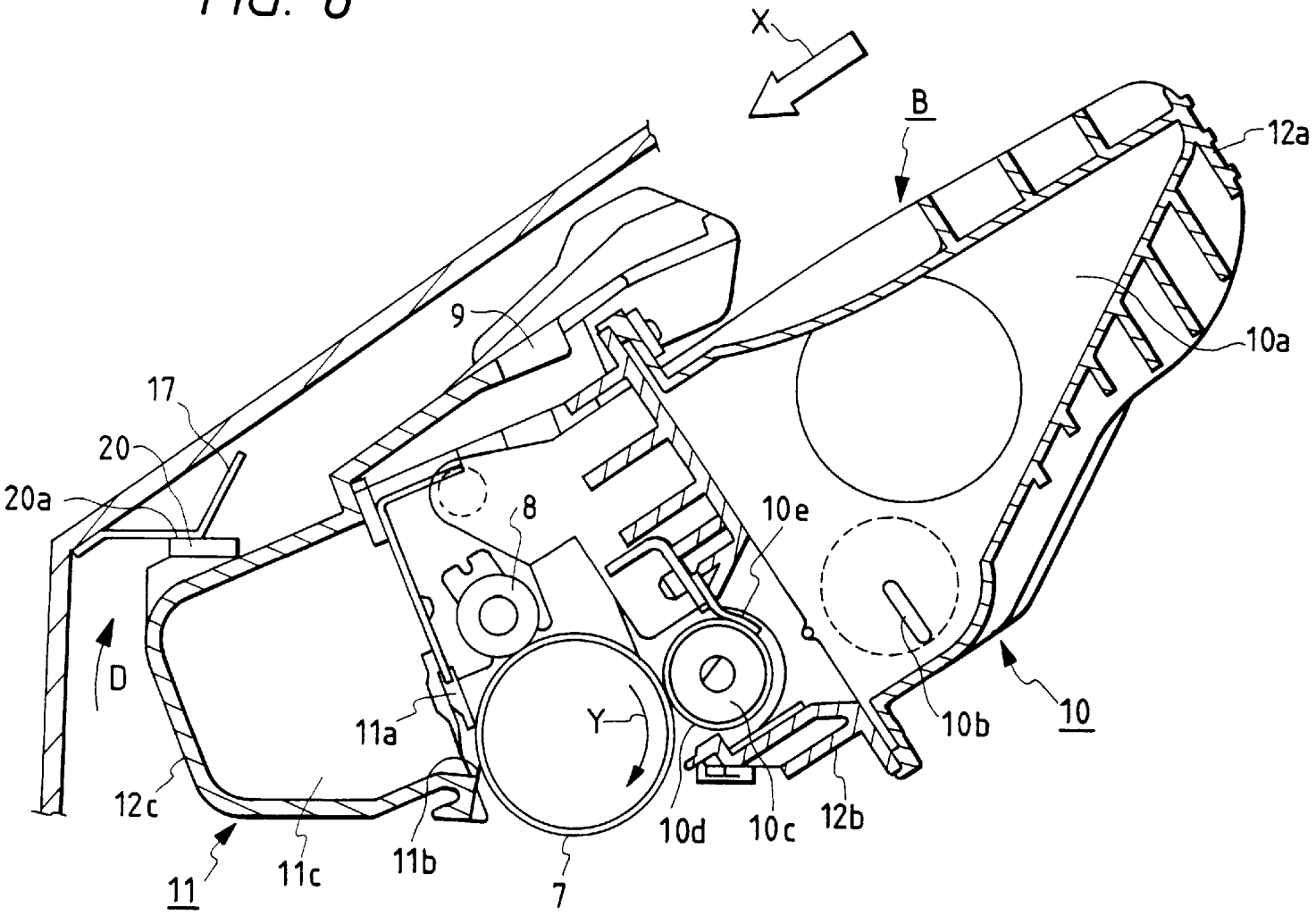
FIG. 6 is an explanatory view showing an electrical connection between a memory means and an image forming apparatus, according to a fourth embodiment of the present invention.

Next, a fourth embodiment of the present invention will be explained with reference to FIG. 6. In the fourth embodiment, the electrical connection between the memory means 20 and the image forming apparatus A differs from those of the previous embodiments.

In this fourth embodiment, the memory means 20 is attached to the upper portion of the cleaning frame 12*c* of the process cartridge B in the longitudinal convey area and is secured to the cleaning frame 12*c*. A contact portion 20*a* of the memory means 20 is disposed on the upper portion of the cleaning frame 12*c*, and a contact 17 of the image forming apparatus is opposed to the contact portion.

With this arrangement, when the process cartridge is subjected to the driving force within the image forming apparatus, the process cartridge is rotatingly biased to positively interconnect the electric contacts.

Fifth Embodiment

Figure 7:
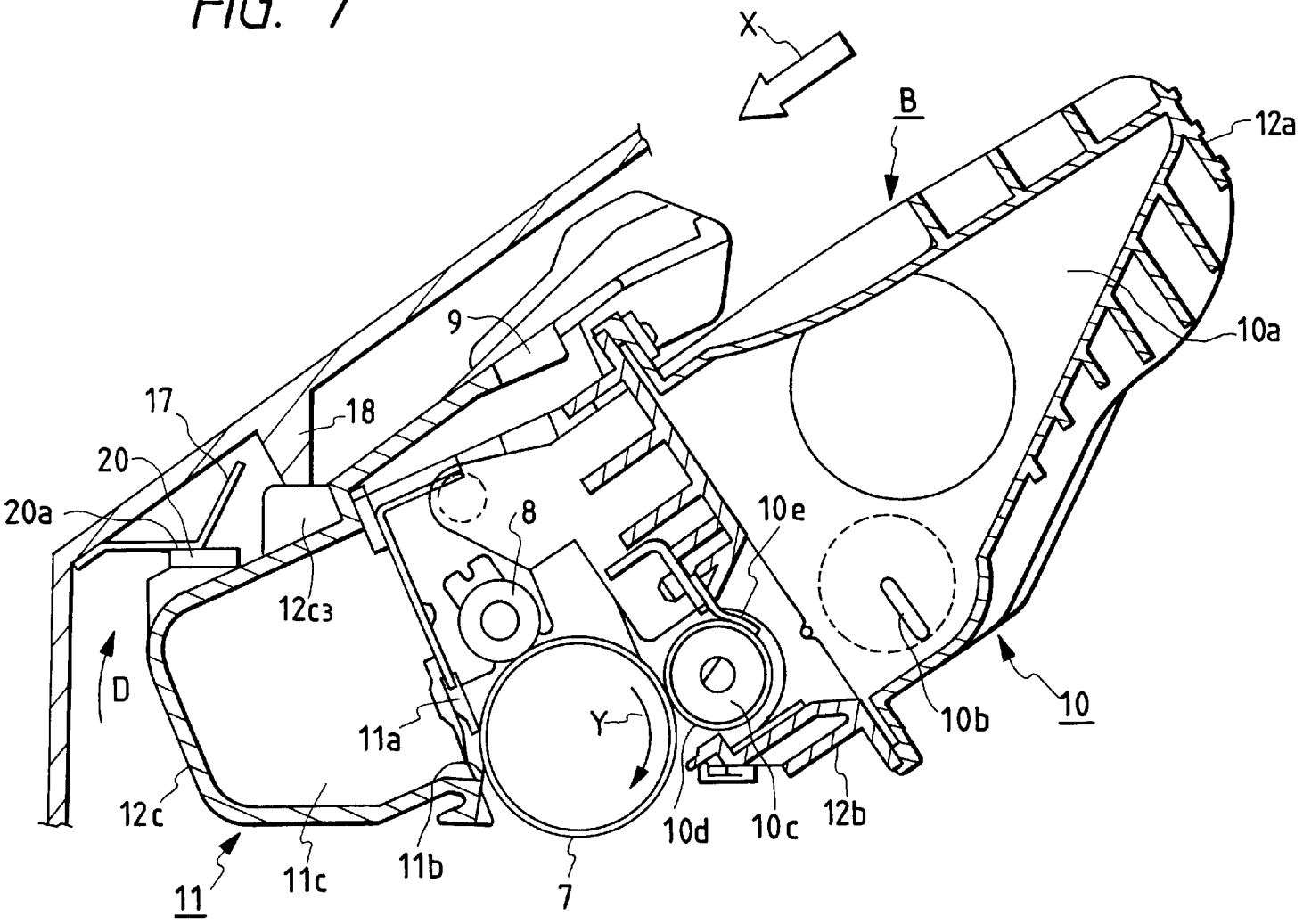
FIG. 7 is an explanatory view showing an electrical connection between a memory means and an image forming apparatus, according to a fifth embodiment of the present invention.
Figure 8:
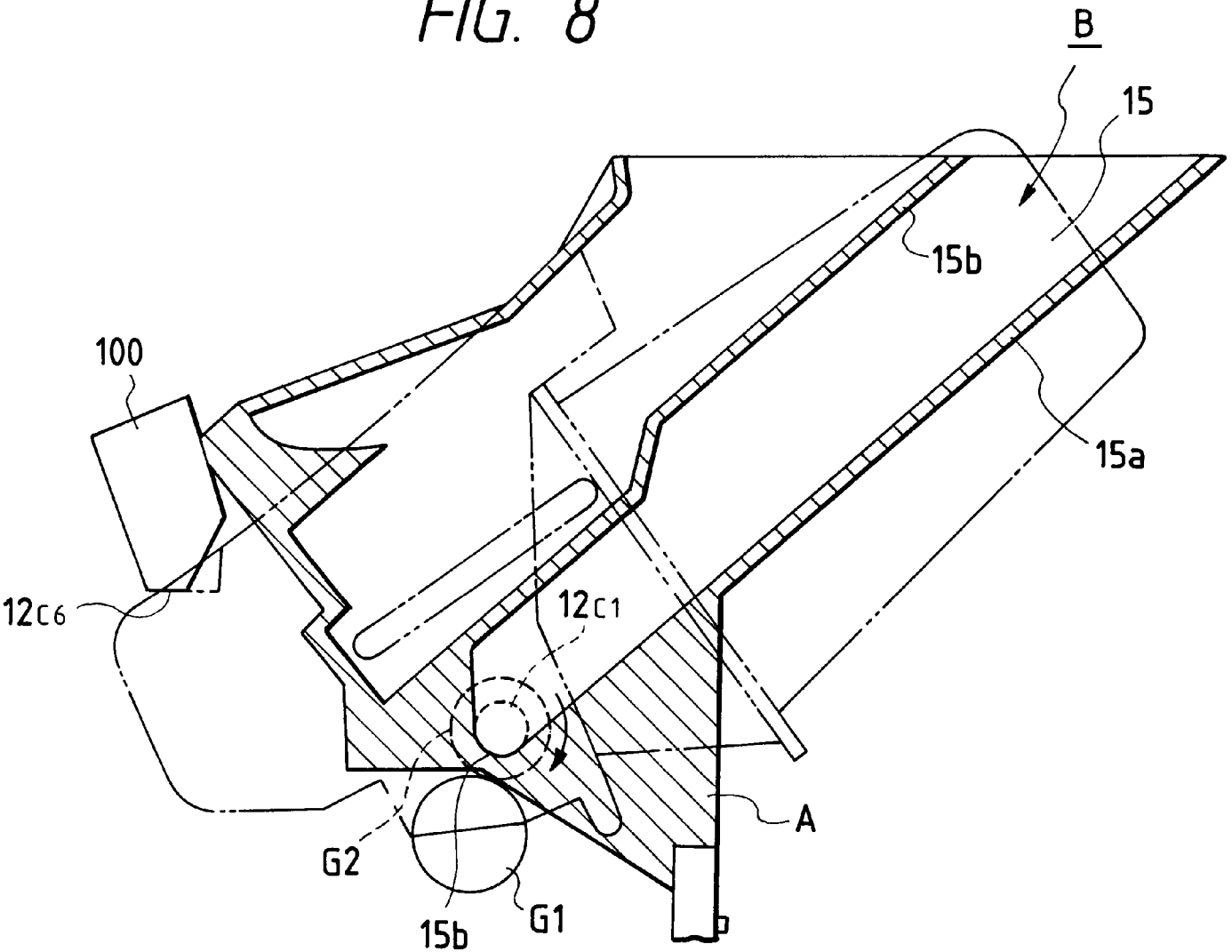
FIG. 8 is a side sectional view showing an internal construction of a portion of the image forming apparatus.

Next, a fifth embodiment of the present invention will be explained with reference to FIG. 7. In the fourth embodiment, the electrical connection between the memory means 20 and the image forming apparatus A differs from those of the previous embodiments.

The memory means 20 is attached to the upper portion of the cleaning frame 12*c* of the process cartridge B in the longitudinal convey area and is secured to the cleaning frame 12*c*. A contact portion 20*a* of the memory means 20 is disposed on the upper portion of the cleaning frame 12*c*, and a contact 17 of the image forming apparatus is opposed to the contact portion. In the vicinity of the contact, there is provided an abutment member 12*c*3 of the process cartridge acting as a stopper when the process cartridge is rotatingly biased in the direction shown by the arrow within the image forming apparatus by the driving force from the image forming apparatus, and an abutment portion 18 of the image forming apparatus is opposed to the abutment portion 12*c*3.

With this arrangement, when the process cartridge is subjected to the driving force within the image forming apparatus, the process cartridge is rotatingly biased in the direction shown by the arrow to abut the abutment portion 12*c*3 against the abutment portion 18. Since the memory means 20 and the contact 17 of the image forming apparatus are disposed in the vicinity of the abutment portions 12*c*3, 18, it is difficult for flexure of the cleaning frame to have an influence upon the memory means and the contact, and the parts can be positioned with high accuracy, with the result that the contacts can stably be contacted with each other, thereby improving the reliability of the contacts.

As mentioned above, the memory means 20 has the cartridge electric contact 23*a* (disposed on the upper surface of the cleaning frame 12*c*) adapted to be connected to the electric contact 16 of the image forming apparatus A when the process cartridge B is mounted on the image forming apparatus A. The cartridge electric contact 23*a* is connected to the contact 16 of the image forming apparatus in the rotational direction (shown by the arrow D) along which the process cartridge B tries to rotate when the process cartridge is subjected to the driving force from the image forming apparatus A. Accordingly, since the cartridge electric contact 23*a* is connected to the contact 16 of the image forming apparatus in a condition that the rotation of the process cartridge is prevented by the abutment between the abutment portions 12*c*3 and 18, the electrical connection can be stabilized. The upper surface of the cleaning frame 12*c* is an upper surface in a condition that the process cartridge B is mounted on the image forming apparatus A.

According to the above-mentioned embodiments, the process cartridge (B) is removably mounted to an electrophotographic image forming apparatus and comprises a cartridge frame (12*c*), an electrophotographic photosensitive member (7) provided within the cartridge frame, a process means (8, 10, 11) acting on the electrophotographic photosensitive member, a memory means (20) for storing information to be transmitted to the electrophotographic image forming apparatus, a positioning portion (12*c*1, 100, 12*c*3, 18) for positioning the cartridge frame with respect to the image forming apparatus when the process cartridge (B) is mounted to the image forming apparatus (A), and an exposure opening (9) provided in the cartridge frame and adapted to pass information light from the image forming apparatus to be illuminated on the electrophotographic photosensitive member when the process cartridge is mounted to the image forming apparatus. The process cartridge (B) is mounted to the image forming apparatus (A) from a direction transverse to an axis of the electrophotographic photosensitive member (7), and the memory means (20) is provided on a tip end portion of the cartridge frame regarding a mounting direction along which the process cartridge (B) is mounted to the image forming apparatus (A) or on a portion of the cartridge frame near the exposure opening (9).

The memory means (20) is disposed an upper surface of the cartridge frame forwardly of the exposure opening (9) in the mounting direction X and the upper surface of the cartridge frame 12*c* is an upper surface when the process cartridge is mounted on the image forming apparatus. The upper surface of the cartridge frame is disposed above a removed toner containing portion (11*c*) for containing toner removed from the electrophotographic photosensitive member.

Further, the tip end portion in the mounting direction is a front surface when the process cartridge (B) is mounted on the image forming apparatus (A). The front surface is disposed above a removed toner containing portion (11*c*) for containing toner removed from the electrophotographic photosensitive member (7).

Further, the memory means has a cartridge electric contact (23*a*) adapted to be connected to the electric contact (16) of the image forming apparatus (A) when the process cartridge (B) is mounted on the image forming apparatus. The cartridge electric contact can be moved in a plane contacting with an imaginary circle coaxial with a rotational center of the process cartridge rotated when the process cartridge is subjected to a driving force from the image forming apparatus.

The rotational center is disposed on a line coaxial with an axis of the drum-shaped electrophotographic photosensitive member (7). Further, the memory means has a cartridge electric contact (23*a*) adapted to be connected to the electric contact (16) of the image forming apparatus (A) when the process cartridge (B) is mounted on the image forming apparatus and the cartridge electric contact is connected to the electric contact of the image forming apparatus in a rotational direction along which the process cartridge tries to rotate when the process cartridge is subjected to the driving force from the image forming apparatus.

The cartridge frame (12*c*) holds the electrophotographic photosensitive member (7) and a charge means (8) as the process means for charging the electrophotographic photosensitive member, and the cartridge frame (12*c*) is pivotally connected to a toner developing frame (12*a*, 12*b*) including a developing member (10*d*) as the process means for developing a latent image formed on the electrophotographic photosensitive member (7) and a toner containing portion (10*a*) for containing toner used by the developing member (10*d*) for development. The cartridge frame (12*c*) supports a cleaning member (11*a*) for removing the toner remaining on the electrophotographic photosensitive member (7).

Further, the memory means (20) comprises a non-volatile memory. The non-volatile memory is a ROM or a RAM. Further, the information includes a lot number of the process cartridge (B) and/or a feature of the electrophotographic photosensitive member (7) and/or features of the process means (8, 10, 11). Further, the positioning portions (12*c*1, 100, 12*c*3, 18) are contact portions provided on an upper surface when the process cartridge (B) is mounted on the image forming apparatus (A), and the contact portions are contacted with fixed members (18, 100) of the image forming apparatus (A), thereby preventing the rotation of the process cartridge.

More specifically, the process cartridge comprises an electrophotographic photosensitive drum (7), a charge member (8) for charging the electrophotographic photosensitive drum (7), a drum frame (12*c*) for supporting the photosensitive drum (7) and the charge member (8), a developing member (10*d*) for developing a latent image formed on the electrophotographic photosensitive drum (7), a developing toner frame (12*a*, 12*b*) supporting the developing member (10*d*) and having a toner containing portion (10*a*) for containing toner used by the developing member (10*d*) for development and pivotally connected to the drum frame (12*c*), an exposure opening (9) provided in the cartridge frame along a longitudinal direction of the electrophotographic photosensitive drum (7) and adapted to pass information light from the image forming apparatus (A) to be illuminated on the electrophotographic photosensitive member (7) when the process cartridge (B) is mounted to the image forming apparatus (A), a projecting member (12*c*1) protruded from the drum frame (12*c*) outwardly in a direction coaxial with an axis of the electrophotographic photosensitive drum (7) and adapted to be supported by a support member (15*b*) of the image forming apparatus (A) when the process cartridge (B) is mounted to the image forming apparatus (A), a contact portion (12*c*1, 12*c*3) provided on the drum frame (12*c*) and adapted to be contacted with a fixed member (18, 100) of the image forming apparatus A when the process cartridge (B) is mounted to the image forming apparatus (A) and further adapted to prevent the process cartridge from rotating toward a rotational direction of the electrophotographic photosensitive member, and a memory member (20) provided on the drum frame (12*c*) adapted to store information to be transmitted to the electrophotographic image forming apparatus (A). The process cartridge (B) is mounted to the image forming apparatus (A) from a direction transverse to an axis of the electrophotographic photosensitive member (7) with the drum frame facing forwardly and with the developing frame facing rearwardly.

Incidentally, the present invention is not limited to the above-mentioned constructions, but various arrangements can be appropriately selected.

Further, it should be noted that the present invention can use any combinations of the above embodiments to obtain further advantages.

As is apparent from the above explanations, according to the above-mentioned embodiments, the memory means can be mounted without interference with a convey path of the toner, so that a process cartridge and an image forming apparatus having such a process cartridge wherein the removed toner in the cleaning means can be collected efficiently are provided.

Further, since the process cartridge can be mounted with highly accurate positioning and the electrical connection between the memory means and the image forming apparatus can be stabilized, there can be provided a process cartridge and an image forming apparatus having such a process cartridge wherein reliability is improved.

As mentioned above, according to the present invention, the electrical connection between the memory means of the process cartridge and the image forming apparatus can be achieved effectively.

What is claimed is:

1. A process cartridge removably mounted to a main body of an electrophotographic image forming apparatus, said process cartridge comprising:

a drum frame;

a developing frame rockably connected to said drum frame;

an electrophotographic photosensitive drum provided on said drum frame;

developing means, disposed on said developing frame, for developing a latent image formed on said electrophotographic photosensitive drum;

a memory disposed to said drum frame, for storing information to be transmitted to the main body of the image forming apparatus;

plural electric contact portions of said process cartridge for connecting themselves electrically to plural electric contact portions of the main body of the image forming apparatus, to transmit information between said memory and the main body of the image forming apparatus, wherein said plural electric contact portions of said process cartridge are provided downstream of said memory in a mounting direction in which said process cartridge is mounted to a predetermined mount position provided on the main body of the image forming apparatus, and said plural electric contact portions of said process cartridge are disposed on the drum frame; and positioning means for positioning said drum frame with respect to the main body of the image forming apparatus when said process cartridge is mounted thereto, wherein said process cartridge is mountable onto the main body of the image forming apparatus in a direction transverse to an axis of said electrophotographic photosensitive drum such that said developing frame trails said drum frame.

2. A process cartridge according to claim 1, wherein said memory is disposed on an upper surface of said drum frame and faced upwardly when said process cartridge is mounted on the main body of the image forming apparatus.

3. A process cartridge according to claim 2, wherein said upper surface of said drum frame is disposed above a removed toner containing portion for containing toner removed from said electrophotographic photosensitive drum.

4. A process cartridge according to claim 1, wherein said memory is disposed on a front surface of said process cartridge so that said memory leads said developing frame when said process cartridge is inserted into the main body of the image forming apparatus.

5. A process cartridge according to claim 4, wherein said front surface is disposed above a removed toner containing portion for containing toner removed from said electrophotographic photosensitive drum.

6. A process cartridge according to claim 1, wherein said memory has a cartridge electric contact to be connected to an electric contact of the main body of the image forming apparatus when said process cartridge is mounted to the main body of the image forming apparatus, and wherein said cartridge electric contact can be moved in a plane contacting with an imaginary circle coaxial with a rotational center of said process cartridge rotated when said process cartridge is subjected to a driving force from the main body of the image forming apparatus.

7. A process cartridge according to claim 6, wherein said rotational center of said process cartridge is coaxial with said electrophotographic photosensitive drum.

8. A process cartridge according to claim 1, wherein said memory has a cartridge electric contact to be connected to an electric contact of the main body of the image forming apparatus when said process cartridge is mounted thereon, and wherein said cartridge electric contact is connected to the electric contact of the main body of the image forming apparatus in a rockable direction along which said process cartridge tries to rock when said process cartridge is subjected to a driving force from the main body of the image forming apparatus.

9. A process cartridge according to claim 1, wherein said drum frame holds said electrophotographic photosensitive drum and charge means for charging said electrophotographic photosensitive drum, and wherein said drum frame is pivotally connected to a toner developing frame including a developing roller as said developing means for developing a latent image formed on said electrophotographic photosensitive drum and a toner containing portion for containing toner used by said developing roller for development.

10. A process cartridge according to claim 9, wherein said drum frame further supports a cleaning member for removing toner remaining on said electrophotographic photosensitive drum.

11. A process cartridge according to claim 1, 3, 5, 6, 8, or 9, wherein said memory comprises a non-volatile memory.

12. A process cartridge according to claim 11, wherein said non-volatile memory is a ROM or a RAM.

13. A process cartridge according to claim 1, wherein the information includes at least one of a lot number of said process cartridge and a feature of said electrophotographic photosensitive drum and features of process means for acting on said electrophotographic photosensitive drum.

14. A process cartridge according to claim 1, wherein said positioning means includes a protruded member protruded outwardly from said drum frame in a direction coaxial with the axis of said electrophotographic photosensitive drum.

15. A process cartridge according to claim 14, wherein said protruded member is an outwardly protruded drum shaft portion for supporting said electrophotographic photosensitive drum on said drum frame.

16. A process cartridge according to claim 14, wherein said protruded member is a protruded portion of said drum frame protruded outwardly of said drum frame.

17. A process cartridge according to claim 14 or 16, wherein said protruded member also acts as a guiding member when said process cartridge is mounted onto the main body of the image forming apparatus.

18. A process cartridge according to claim 14, wherein said positioning means further includes a contact portion provided on an upper surface of said process cartridge when said process cartridge is mounted on the main body of the image forming apparatus, and wherein said contact portion is contacted with a fixed member of the main body of the image forming apparatus, thereby preventing rotation of said process cartridge.

19. A process cartridge according to claim 1, wherein said positioning means is a recess formed on an upper surface faced upwardly when said process cartridge is mounted onto the main body of the image forming apparatus, said recess being abutted to a fixed member of the main body to thereby position said drum frame.

20. A process cartridge removably mounted to a main body of an electrophotographic image forming apparatus, said process cartridge comprising:

an electrophotographic photosensitive drum;

a charge member for charging said electrophotographic photosensitive drum;

a drum frame for supporting said electrophotographic photosensitive drum and said charge member;

a developing member for developing a latent image formed on said electrophotographic photosensitive drum;

a developing toner frame supporting said developing member and having a toner containing portion for containing toner used by said developing member for development and being rockably connected to said drum frame;

an exposure opening provided along a longitudinal direction of said electrophotographic photosensitive drum to pass information light from the main body of the image forming apparatus to be illuminated on said electrophotographic photosensitive drum when said process cartridge is mounted to the main body of the image forming apparatus;

a projecting member protruded from said drum frame outwardly in a direction coaxial with said electrophotographic photosensitive drum to be supported by a support member of the main body of the image forming apparatus when said process cartridge is mounted thereto;

a contact portion provided on said drum frame to be contacted with a fixed member of the main body of the image forming apparatus when said process cartridge is mounted thereto, and to prevent said process cartridge from rotating toward a rotational direction of said electrophotographic photosensitive drum;

a memory disposed to said drum frame to store information to be transmitted to the main body of the image forming apparatus, and plural electric contact portions of said process cartridge for connecting themselves electrically to plural electric contact portions of the main body of the image forming apparatus to transmit information between said memory and the main body of the image forming apparatus, wherein said plural electric contact portions of the process cartridge are provided downstream of the memory in a mounting direction in which said process cartridge is mounted to a predetermined mount position provided on the main body of the image forming apparatus, and the plural electric contact portions of the process cartridge are disposed on the drum frame; and wherein said process cartridge is mountable onto the main body of the image forming apparatus in a direction transverse to an axis of said electrophotographic photosensitive drum such that said developing toner frame trails said drum.

21. A process cartridge according to claim 20, wherein said memory member is disposed on an upper surface of said drum frame and faced upwardly when said process cartridge is mounted on the main body of the image forming apparatus.

22. A process cartridge according to claim 21, wherein said upper surface of said drum frame is disposed above a removed toner containing portion for containing toner removed from said electrophotographic photosensitive drum.

23. A process cartridge according to claim 20, wherein said memory member is disposed on a front surface of said process cartridge so that said memory member leads said developing toner frame when said process cartridge is inserted into the main body of the image forming apparatus.

24. A process cartridge according to claim 23, wherein said front surface is disposed above a removed toner containing portion for containing toner removed from said electrophotographic photosensitive drum.

25. A process cartridge according to claim 20, wherein said drum frame supports a cleaning member for removing toner remaining on said electrophotographic photosensitive drum.

26. A process cartridge according to claim 20, wherein said memory member comprises a non-volatile memory.

27. A process cartridge according to claim 26, wherein said non-volatile memory is a ROM or a RAM.

28. A process cartridge according to claim 20, wherein the information includes at least one of a lot number of said process cartridge and a feature of said electrophotographic photosensitive drum and features of process means for acting on said electrophotographic photosensitive drum.

29. A process cartridge according to claim 20, wherein said projecting member is an outwardly protruded drum shaft portion for supporting said electrophotographic photosensitive drum on said drum frame.

30. A process cartridge according to claim 20, wherein said projecting member is a protruded portion of said drum frame and is protruded outwardly from said drum frame.

31. A process cartridge according to claim 20, wherein said memory member has a cartridge electric contact to be connected to an electric contact of the main body of the image forming apparatus when said process cartridge is mounted on the main body of the image forming apparatus, and wherein said cartridge electric contact can be moved in a plane contacting with an imaginary circle coaxial with a rotational center of said process cartridge rotated when said process cartridge is subjected to a driving force from the main body of the image forming apparatus.

32. A process cartridge according to claim 31, wherein said rotational center of said process cartridge is coaxial with said electrophotographic photosensitive drum.

33. A process cartridge according to claim 20, wherein said memory member has a cartridge electric contact to be connected to an electric contact of the main body of the image forming apparatus when said process cartridge is mounted thereon, and wherein said cartridge electric contact is connected to the electric contact of the main body of the image forming apparatus in a rockable direction along which said process cartridge tries to rock when said process cartridge is subjected to a driving force from the main body of the image forming apparatus.

34. An electrophotographic image forming apparatus to which a process cartridge can removably be mounted and which forms an image on a recording medium, said image forming apparatus comprising:

(a) mounting means capable of removably mounting a process cartridge including a drum frame, a developing frame rockably connected to the drum frame, an electrophotographic photosensitive drum provided on the drum frame, developing means disposed on the developing frame for developing a latent image formed on the electrophotographic photosensitive drum, a memory disposed to the drum frame for storing information to be transmitted to a main body of said image forming apparatus, plural electric contact portions of the process cartridge for connecting themselves electrically to plural electric contact portions of the main body of the image forming apparatus to transmit information between the memory and the main body of the image forming apparatus, wherein the plural electric contact portions of said process cartridge are provided downstream of the memory in a mounting direction in which said process cartridge is mounted to a predetermined mount position provided on the main body of the image forming apparatus, and the plural electric contact portions of said process cartridge are disposed on the drum frame, and positioning means for positioning the drum frame with respect to the main body of said image forming apparatus when the process cartridge is mounted thereto, wherein said process cartridge is mountable onto the main body of the image forming apparatus in a direction transverse to an axis of said electrophotographic photosensitive drum such that said developing frame trails said drum frame;

(b) the plural electric contact portions of said main body to be contacted with the plural electric contact portions of said process cartridge; and (c) convey means for conveying a recording medium.

35. An image forming apparatus according to claim 34, wherein said electric contact of said main body of said image forming apparatus can be moved in a plane contacting with an imaginary circle coaxial with a rotational center of the process cartridge rotated when the process cartridge is subjected to a driving force from said main body of said image forming apparatus.

36. An electrophotographic image forming apparatus to which a process cartridge can removably be mounted and which forms an image on a recording medium, said image forming apparatus comprising:

(a) a mounting member capable of removably mounting a process cartridge including an electrophotographic photosensitive drum, a charge member for charging the electrophotographic photosensitive drum, a drum frame for supporting the electrophotographic photosensitive drum and the charge member, a developing member for developing a latent image formed on the electrophotographic photosensitive drum, a developing toner frame supporting the developing member and having a toner containing portion for containing toner used by the developing member for development and being rockably connected to the drum frame, an exposure opening provided along a longitudinal direction of the electrophotographic photosensitive drum to pass information light from a main body of said image forming apparatus to be illuminated on the electrophotographic photosensitive drum when the process cartridge is mounted to said main body of said image forming apparatus, a projecting member protruded from the drum frame outwardly in a direction coaxial with an axis of the electrophotographic photosensitive drum to be supported by a support member of said main body of said image forming apparatus when the process cartridge is mounted thereto, a contact portion provided on the drum frame to be contacted with a fixed member of said main body of said image forming apparatus when the process cartridge is mounted thereto and to prevent the process cartridge from rotating toward a rotational direction of the electrophotographic photosensitive drum, a memory disposed on the drum frame to store information to be transmitted to said main body of said image forming apparatus, and plural electric contact portions of said process cartridge for connecting themselves electrically to plural electric contact portions of the main body of the image forming apparatus to transmit information between the memory and the main body of the image forming apparatus, wherein the plural electric contact portions of said process cartridge are provided downstream of the memory in a mounting direction in which said process cartridge is mounted to a predetermined mount position provided on the main body of the image forming apparatus, and the plural electric contact portions of said process cartridge are disposed on the drum frame, wherein the memory is disposed forwardly of the exposure opening in a mounting direction along which the process cartridge is mounted to said main body of said image forming apparatus, and wherein said process cartridge is mountable onto the main body of the image forming apparatus in a direction transverse to an axis of said electrophotographic photosensitive drum such that said developing toner frame trails said drum frame;

(b) a light emitting member for emitting information light incident on the electrophotographic photosensitive drum through the exposure opening of the process cartridge mounted on said mounting member;

(c) a fixed member to be contacted with the contact portion of the process cartridge mounted on said mounting member;

(d) convey means for conveying a recording medium; and (e) the electric contact portions of said main body of said image forming apparatus to be contacted with the electric contact portions of said process cartridge.

37. An image forming apparatus according to claim 36, wherein said electric contact of the main body of said image forming apparatus can be moved in a plane contacting with an imaginary circle coaxial with a rotational center of the process cartridge rotated when the process cartridge is subjected to a driving force from said main body of said image forming apparatus.

* * * * *

UNITED STATES PATENT AND TRADEMARK OFFICE

CERTIFICATE OF CORRECTION

PATENT NO. : 5,937,239

DATED : August 10, 1999

INVENTOR(S) : KAZUSHI WATANABE, ET AL.

It is certified that error appears in the above-identified patent and that said Letters Patent is hereby corrected as shown below:

COLUMN 3

Line 61, "of" (first occurrence) should be deleted.

COLUMN 10

Line 14, "forwardly" should read --forward--.

COLUMN 12

Line 52, "above" should read --on--.

COLUMN 14

Line 67, "above" should read --on--.

Signed and Sealed this

Twenty-seventh Day of June, 2000

*Attest:*

Q. TODD DICKINSON

*Attesting Officer*

*Director of Patents and Trademarks*